United States Patent [19]

Schwarz et al.

[11] Patent Number: 4,869,640

[45] Date of Patent: Sep. 26, 1989

[54] CONTROLLED TEMPERATURE ROTATING SEAL

[75] Inventors: Frederick M. Schwarz; David J. Candelori, both of Glastonbury, Conn.

[73] Assignee: United Technologies Corporation, Hartford, Conn.

[21] Appl. No.: 245,250

[22] Filed: Sep. 16, 1988

[51] Int. Cl.[4] ..... F04D 29/58

[52] U.S. Cl. ..... 415/115; 415/173.7; 415/116

[58] Field of Search ..... 415/115, 116, 170 R

[56] References Cited

U.S. PATENT DOCUMENTS

| | | | |
|---|---|---|---|
| 3,034,298 | 5/1962 | White | 415/116 |
| 4,213,738 | 7/1980 | Williams | 415/115 |
| 4,332,133 | 6/1982 | Schwarz et al. | 60/39.75 |
| 4,378,961 | 4/1983 | Trousdell | 415/137 |
| 4,708,588 | 11/1987 | Schwarz et al. | 415/116 |
| 4,741,153 | 5/1988 | Hallinger et al. | 415/116 |

*Primary Examiner*—Robert E. Garrett
*Assistant Examiner*—John T. Kwon
*Attorney, Agent, or Firm*—Troxell K. Snyder

[57] ABSTRACT

A temperature controlled rotating seal (46) includes an annular runner (48) having knife edges (50) and a surrounding static shroud (44). Baffles (64, 66) extend radially from the adjacent rotor (10) and a static stator vane assembly (36), forming a plurality of annular mixing volumes (60, 62) disposed upstream of the seal (46). Cool air (70) is provided to the innermost mixing volume (62) thereby controlling the local gas temperatures at the rotor periphery (14).

4 Claims, 2 Drawing Sheets

CONTROLLED TEMPERATURE ROTATING SEAL

FIELD OF THE INVENTION

The present invention relates to a configuration of a rotating seal, and more particularly, to a rotating seal in a gas turbine engine.

BACKGROUND

Temperature control of various structures in the turbine section of a gas engine, or the like, has long been a concern of designers and engine operators. Gas turbine engine working fluid, composed of combustion products, reaches temperatures in excess of 3,000° F. in modern engines. Despite advances in materials technology, such temperatures not only limit the allowable stress in materials, but also reduce time between replacement and/or maintenance.

One particular structure of the gas turbine engine which is most highly stressed and which therefore requires the most thermal protection is the periphery of the rotor disk which receives and retains the individual rotor blades. Although the airfoil shaped portions of the rotor blades are immersed directly in the high temperature working fluid, it is the radially inward root portion of the individual blades as well as the radially coincident periphery of the rotor disk which is subject to the greatest force loading as the rotor spins at typical operating angular speeds of 15,000 rpm or higher.

Gas turbine engines typically have two or more rotor stages spaced axially and separated by an intermediate stator stage comprising a plurality of fixed stator vanes also having airfoil cross sections which redirect the working fluid exiting the upstream turbine stage so as to optimally interact with the adjacent downstream rotor stage. Overall engine energy conversion efficiency requires that the quantity of working fluid bypassing the airfoil portions of the turbine blades and stator vanes be held to a minimum, thus requiring rotating seals between the radially outer tips of the individual rotor blade airfoils and the engine case, as well as between the radially inner diameter of the stator vane stage and a corresponding rotating runner extending axially between adjacent rotor stages. The temperature distribution adjacent the stator rotating seal is of particular importance as this region lies directly adjacent the peripheries of the rotor disks and is thus of prime importance in determining the allowable stress limit in this portion of the turbine structure.

Typical rotating seals between the inner diameter of the stator and the axially extending rotor spacer include a runner having a plurality of radially outwardly projecting knife edges which extend circumferentially with respect to the runner, and an annular shroud of honeycomb or other abradable material disposed radially adjacent the runner knife edges and secured at the inner diameter of the stator assembly, thereby forming a labyrinth type rotating seal. This seal, disposed radially inward of the annular stream of working fluid, must accommodate variation in both the radial and axial displacement of the stator shroud and knife edges as the engine experiences different operating power levels, environments, and transients.

As is well known to those skilled in the gas turbine engine art, such labyrinth seals are not a complete barrier to the passage of bypass gas flow between the upstream and downstream sides of the stator vane stage. Without further accommodation, working fluid would flow radially inward through the annular gap which exists between the upstream rotor blade platforms and the radially inner platforms of the stator vanes, passing through the labyrinth seal structure and reentering the working fluid flow downstream of the stator vane assembly by flowing again radially outward between the corresponding downstream annular gap between the rotor stage and the stator assembly. The high temperature of the working fluid, as noted above, cannot be tolerated by the engine components in this section of the turbine, thus some form of thermal protection is required.

Current practice in this art channels a flow of cooling gas, such as compressed air, from the upstream gas compressor section of the engine, into the annular region disposed immediately upstream of the rotating seal. Sufficient cooling gas can be provided to not only match the leakage which occurs between the knife edges and stator shroud, but, if desired, can also result in a net mass outflow between the upstream rotor and stator platforms. While ultimately effective in reducing the temperature in this critical region, the prior art method of simply discharging sufficient cool gas into the region so as to result in an acceptable local temperature can require up to 1.5% of the total compressor mass flow.

There are several reasons that such a high mass flow of cooling air is required. The first reason requires a recognition that both the upstream and downstream cavities lying adjacent the rotating seal are extremely well mixed due to the pumping action resulting from the rapidly turning rotor stages. Gas molecules at the adjacent rotor face are subject to an induced centrifugal acceleration of up to 50,000 g's, and move radially outward creating a violent gas circulation within the cavity.

The second reason for the high cooling requirement results from the rapidly fluctuating pressure at the annular gap formed at the radially inner flow boundary of the working fluid between the stator stage and the upstream and downstream rotor stages. As each blade sweeps past a fixed point on this annular gap, the local pressure fluctuates due to the passing of the pressure and suction sides of the adjacent blade. Not only is this fluctuating pressure present downstream of the rotor blades, but also, there is a bow wave upstream of the second stage rotor blades. Thus, despite an overall outflow of gas from within the upstream and downstream seal cavities, the fluctuating pressure at the annular gap forces working fluid to flow into the annular seal cavities whereupon it is mixed instantly and thoroughly thereby elevating both the cavity temperature and the amount of cooling gas required.

By providing sufficient cool gas flow to maintain temperature of the seal cavities at an acceptable level, the prior art cooling method also results in an unnecessarily low structure temperature in the relatively lightly stressed radially inward portion of the stator assembly. Specifically, the stator shroud and supporting pedestal are relatively lightly stressed and could withstand higher local gas temperatures without compromising structural integrity or service life. The stator assembly, being fabricated of a plurality of circumferentially adjacent segments, is also subject to an unavoidable volume flow of gas leakage axially through the pedestal portion, thereby resulting in a still further diminishment of overall turbine and engine efficiency.

What is required is a configuration of the stator rotating seal and surrounding structure which achieves thermal protection of the rotor disk peripheries while minimizing consumption of cooling air.

SUMMARY OF THE INVENTION

It is therefore an object of the present invention to provide an improved rotating seal configuration between alternating rotor and stator stages in an axial flow gas turbine engine.

It is further an object of the present invention to provide a rotating seal configuration adapted to control the local gas temperature in the vicinity of the periphery of the rotor disks, and to reduce cooling gas flow as compared to prior art configurations.

It is further an object of the present invention to control the temperature of the gas passing through known leakage paths in the stator assembly, thereby reducing the collective mass flow of such leakage.

It is still further an object of the present invention to provide a rotating seal configuration which achieves controlled mixing of the engine working fluid and the cooling gas for selectively controlling the local gas temperature distribution.

According to the present invention, a configuration for controlling the local gas temperature distribution at the rotating seal between a vane stator assembly and adjacent rotor stages is provided. The rotating seal, typically including a plurality of circumferentially extending knife edges secured to a seal runner axially spanning the gap between the rotors, is located radially inward of the annular, axially flowing stream of engine working fluid. The knife edges run proximate an annular shroud of honeycomb or other abradable material, supported at the inner diameter of the stator assembly, thus achieving a labyrinth-type rotating seal which restricts the flow of working fluid or other gas attempting to bypass the airfoil vanes of the stator assembly.

The invention includes a plurality of annular, axially extending, overlapping baffles alternately secured to facing sides of the stator and the adjacent rotor. The baffles cooperatively define at least two annular mixing volumes between the working fluid stream and the upstream side of the rotating seal. Cooling gas such as compressed air, is ducted into the innermost mixing volume immediately adjacent the upstream side of the rotating seal and the flow rate thereof selected to achieve a desired local gas temperature at the periphery of the rotor disks both upstream and downstream of the rotating seal.

The second upstream mixing volume, disposed between the working fluid stream and inner mixing volume, provides an intermediate temperature gas volume and prevents direct entry of the high temperature working fluid into the mixing volume adjacent the rotating seal. This intermediate temperature volume further provides a source of mixed gas which is admitted into a vane tip volume defined between the radially inner platform of the stator vane assembly and the annular seal shroud, the vane tip volume being also disposed adjacent to a shroud support pedestal which includes various gas leakage pathways.

The radially inner .portion of the stator assembly adjacent to the shroud support pedestal is relatively lightly stressed as compared, for example, to the rotor disk peripheries, and is able to tolerate the presence of the hotter, less dense intermediate temperature gas. By admitting the intermediate temperature gas into the vane tip volume through a sized opening in an upstream, radially extending bulkhead, the configuration according to the present invention displaces the cooler, and hence denser, gas present at the inner vane region in the prior art configuration. This intermediate temperature gas follows the leakage pathways through the pedestal region of the stator assembly, reducing the overall mass flow of leakage as compared to the same volumetric flow of the cooler, denser gas of the prior art configuration.

The present invention further includes a plurality of baffles disposed between the downstream side of the stator assembly and the facing rotor, and which define a second plurality of mixing volumes downstream of the rotating seal. The downstream mixing volumes likewise result in staged mixing of the gas leaking past the rotating seal and through the stator vane pedestal pathways, thus controlling the local temperature in the vicinity of the downstream rotor periphery in a similar fashion as achieved on the upstream side of the stator stage.

By controlling and staging the mixing of the working fluid and cooling gas in the vicinity of the rotor disk peripheries, the seal configuration according to the present invention provides adequate local cooling to the critical, highly stressed rotating components while avoiding overcooling of portions of the nearby, lightly stressed stator structure. The management of the local mixed gas temperatures in the configuration according to the present invention reduces both the demand for cooling gas or air, as well as the mass flow of gas through the stator structure leakage pathways, thereby improving overall engine efficiency.

Both these and other objects and advantages of the seal region configuration according to the present invention will be apparent to those skilled in the art upon review of the following detailed description and the appended claims and drawing figures.

DETAILED DESCRIPTION OF THE PREFERRED EMBODIMENT

1. Prior Art

Figure 1:
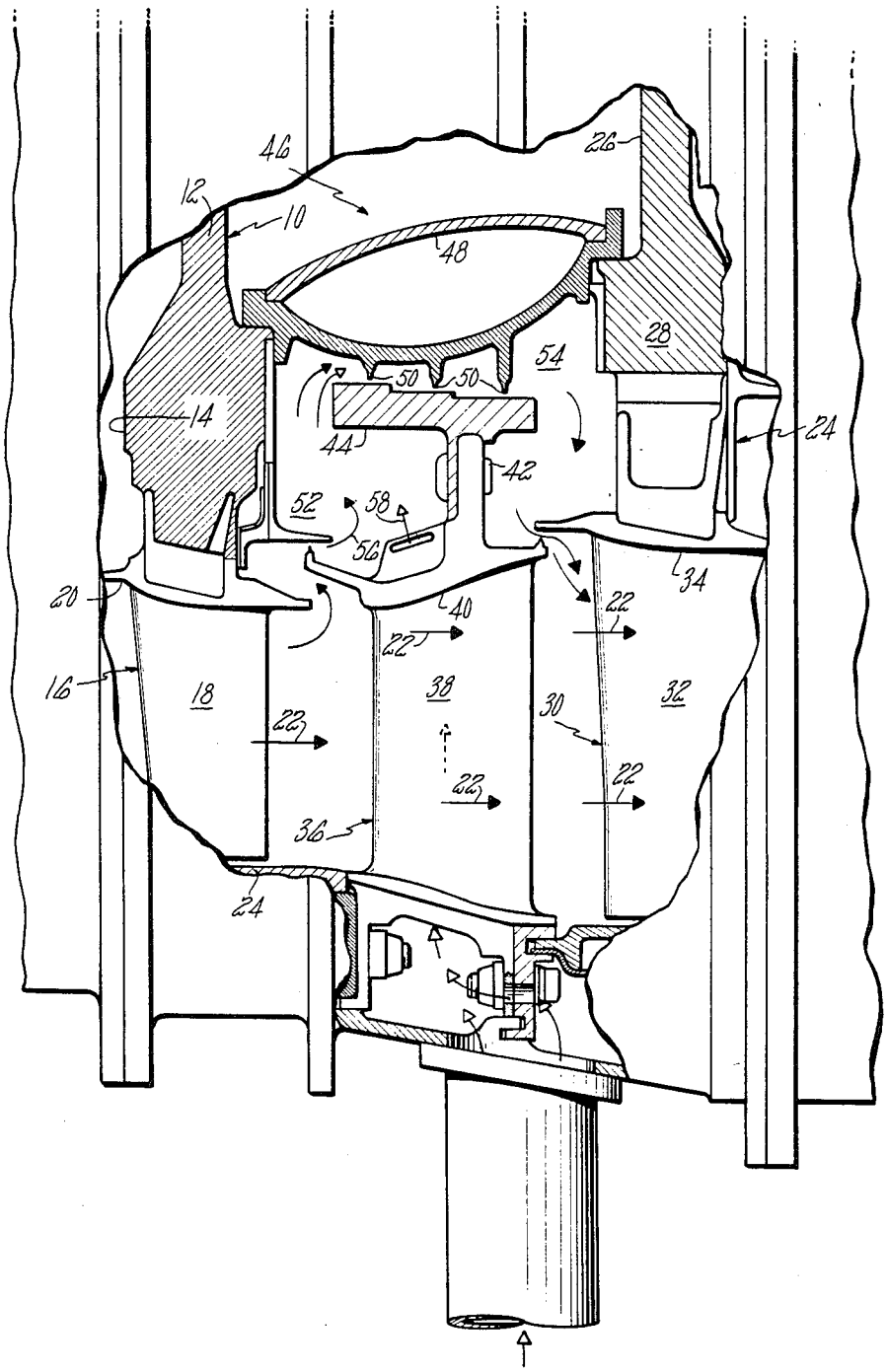
FIG. 1 PRIOR ART
FIG. 1 shows a prior art seal region configuration.

Referring to FIG. 1 of the drawings, a prior art sealing arrangement will be described in detail. FIG. 1 shows a portion of a turbine section of a gas turbine having a first rotor 10 having a radially inner disk portion 12, an annular disk periphery 14, and a plurality of rotor blades 16 each including an airfoil section 18, a platform portion 20 disposed radially inward of the airfoil portion 18, and a root portion (not visible in FIG. 1) engaged with the disk periphery 14.

An annular flow of hot working fluid 22 flows over the airfoil portions 18 of the blades 16, having a flow path generally defined collectively at the radially inner diameter by the blade platforms 20, and at the radially outer diameter by the engine case 24.

A second rotor 24 is disposed downstream of the first rotor 10, and includes a disk portion 26, a periphery 28, and blades 30 as described in conjunction with the first rotor 10. The blades 30 of the second rotor 24 each include an airfoil portion 32, a platform portion 34, and a root portion engaged with the periphery 28 of the corresponding rotor disk 26.

Disposed axially intermediate the first and second rotors 10, 24 is a stator assembly 36 mounted to the engine case 24 and extending radially inward, comprising in sequence an airfoil portion 38, a platform portion 40, a shroud support pedestal 42, and a seal shroud 44. Seal shroud 44 extends annularly about the engine center line (not shown) and forms a part of the rotating seal, designated generally 46 in FIG. 1, which discourages leakage of the working fluid 22 around the airfoil portion 38 of the stator assembly 36. The other part of the rotating seal 46 is a runner assembly 48 which extends axially between the peripheries 14, 28 of the rotor disks 12, 26 and which includes a plurality of radially projecting knife edges 50 which extend circumferentially about the runner 48 achieving, in cooperation with the stator seal shroud 44, a labyrinth-type seal as is well known in the art.

As will be appreciated by those skilled in the art of gas turbine engine design, the most highly stressed portion of the structure shown in FIG. 1 is the periphery 14, 28 of each rotor disk 12, 26. The disk peripheries 14, 28 must resist the induced centrifugal force on the associated rotor blades 16, 30 while being axially slotted for receiving the root portions of the individual blades 16, 30. The ability of the disk peripheries to accommodate such stress concentration is diminished by elevated temperature, thus requiring careful management and control of the local gas temperature. As noted in the preceding background section, the seal volumes 52, 54 defined by the rotors and stator assembly at the upstream and downstream sides of the rotating seal 46 are subject to an inflow 56 of the high temperature working fluid 22 which becomes very quickly mixed with any other gas present in the seal volumes 52, 54, thereby increasing local temperature.

As also noted above, the prior art method for protecting the rotor peripheries 14, 28 from overtemperature utilizes a flow of cooling gas 58, such as compressed air, ducted into the upstream seal cavity 52 via one or more of the stator airfoils 38. The cooling gas 58 mixes with the ingested working fluid 56, thus resulting in a reduced gas temperature adjacent the upstream periphery 14.

As also noted hereinabove, the gas present in the upstream seal volume 52 flows past the seal 46 as well as through various leakage pathways present in the pedestal portion 42 of the stator assembly 36, entering the downstream seal volume 54 which again experiences mixing with working fluid 22 forced into the downstream cavity 54 via the bow wave pumping discussed in the preceding section. The flow rate of gas 58 is thus selected so as to not only sufficiently dilute the thermal effects of the ingested working fluid 56 in the upstream seal cavity 52, but also to protect the downstream cavity 54.

2. Description of the Invention

Figure 2:
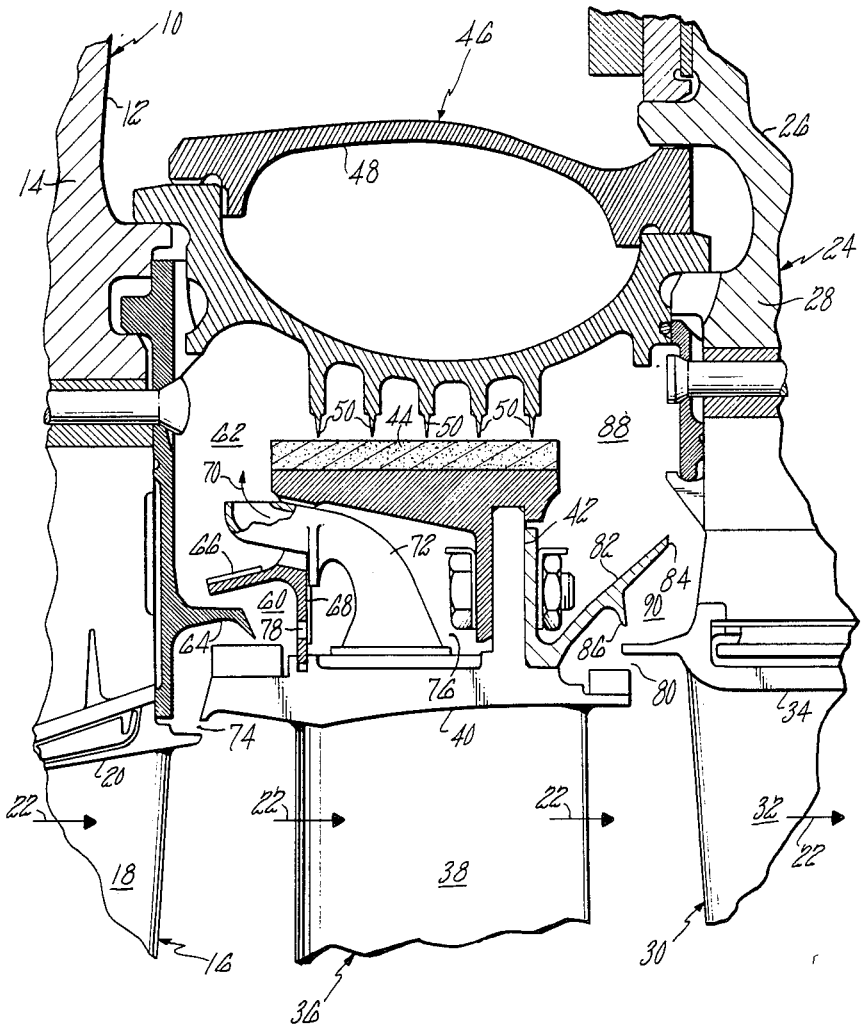
FIG. 2 shows a seal region configuration according to the present invention.

FIG. 2 shows the improved seal configuration according to the present invention. As with the prior art seal arrangement, the first rotor 10 and its various components, disk 12, periphery 14, and blade 16, including airfoil 18 and platform 20, are present. Also shown is the second rotor 24, second rotor disk 26, second rotor periphery 28, and the plurality of blades 30 associated therewith. Each blade 30 includes an airfoil portion 32 and platform 34 as in the prior art configuration. The seal 46 spanning the axial gap between the first and second rotor peripheries 14, 28 is essentially equivalent to the prior art, including a runner 48, knife edges 50. The stator assembly 36 likewise includes radially inwardly extending airfoil portions 38, cooperating platform portions 40 which define a radially inward boundary for the hot working fluid 22 as in the prior art. The stator assembly 36 also includes a pedestal portion 42 which supports the annular abradable seal shroud 44.

Unlike the prior art, the seal configuration according to the present invention comprises a plurality of mixing volumes 60, 62 disposed upstream of the rotating seal 46. These mixing volumes 60, 62 are defined by a plurality of generally axially extending, overlapping annular baffles 64, 66 which are alternatingly secured to the downstream face of the first rotor 10 and to a radially extending bulkhead 68. Cooling gas 70, such as compressed air, enters the innermost mixing volume 62 which is also immediately adjacent the upstream side of the rotating seal 46. This innermost upstream mixing volume 62 also lies adjacent the periphery 14 of the first rotor disk, and receives cooling air 70 flowing radially inward through at least one vane airfoil 38 and, in the preferred embodiment, passing through an extension duct 72 which transfers the cooling gas 70 from the vane airfoil 38 through the upstream bulkhead 68.

The function of the mixing volumes 60, 62 in achieving temperature control in the vicinity of the rotating seal 46 can now be readily appreciated. Hot working fluid 22 flowing radially inward through the annular gap 74 formed between the first rotor blade platforms and the stator platforms 40, either as a result of an overall collective leakage through the seal 46 or by means of the trailing wave pumping action discussed in the background section above, enters the intermediate mixing volume 60 wherein it is diluted and well mixed with lower temperature gas entering the intermediate mixing volume 60 from the innermost mixing volume 62. As noted above, innermost volume 62 receives a flow of cooling gas 70 which further dilutes any intermediate temperature gas ingested from the intermediate mixing volume 60. Thus, the amount of cooling gas 70 required to maintain the required temperature in the innermost mixing volume 62 is less than would be required if the working fluid 22 were allowed to mix directly therewith.

The present invention thus provides staged mixing of any ingested working fluid 22 prior to reaching the upstream side of the rotating seal 46 and hence the periphery of the corresponding rotor disk 12. By way of further explanation, the configuration according to the present invention confines the diluting and cooling effect of the supplied cooling gas 70 to the innermost mixing volume 62 wherein the temperature limit is of critical importance. Intermediate mixing volume 60, as well as the annular gap 74, are disposed adjacent relatively lightly stressed structures, such as the stator 36, which are able to withstand far higher local temperatures than the highly stressed disk periphery 14.

Another advantage of the staged mixing achieved by the configuration according to the present invention is the control of gas temperature in the vane tip volume 76 defined between the vane platforms 40, pedestal 42, annular shroud 44 and bulkhead 68. This tip volume, in fluid communication with the leakage paths between the annular seal shroud segments and stator pedestal 42, is part of the path of gas leakage between the vane platforms 40 and the seal shroud 44. By providing a sized opening 78 in the bulkhead 68, the flow of intermediate temperature gas from the intermediate mixing volume 60 into the tip volume 76, and hence the temperature of the gas within the tip volume 76, may be determined by the designer. As noted hereinabove, the structure in this region is relatively lightly stressed, hence able to withstand far higher local gas temperatures.

The configuration according to the present invention thus provides an elevated volume of gas in the vane tip region 76 which has a lower density as compared to the lower temperature gas in the innermost mixing volume 62. Thus, while not necessarily diminishing the volumetric leakage through the pedestal region 42 of the stator 36, the seal configuration according to the present invention nonetheless achieves a reduction in the overall mass flow of leakage in this critical area by virtue of the lower density of the higher temperature gas present in the vane tip volume 76.

As noted hereinabove, the downstream side of the rotating seal 46 is also subject to ingestion of the working fluid 22 via the corresponding downstream annular gap 80 occurring between the second rotor blade platforms 34 and the stator platforms 40. The temperature effect of this downstream cavity pumping is controlled in the configuration according to the present invention by means of a double lipped annular baffle 82 secured to the pedestal portion 42 of the stator 36 and including, in cross section, a first lip 84 and a second lip 86 which define an inner downstream mixing volume 88, and an intermediate volume 90 between the downstream side of the rotating seal 46 and the corresponding annular gap 80. Thus, working fluid 22 ingested via annular gap 80 first must enter intermediate downstream mixing volume 90 wherein it mixes and is diluted with gas exiting the downstream innermost mixing volume 88. Downstream innermost mixing volume 88, to the extent it experiences an exchange of gas with the intermediate downstream volume 90, is heated thereby, but to a degree far less than the prior art downstream volume 54 by virtue of the temperature moderating action of the intermediate volume 90.

The seal configuration according to the present invention is thus well suited to achieve the objects and advantages set forth hereinabove. It will further be appreciated by those skilled in the art that the embodiment illustrated in FIG. 2 hereof is merely illustrative, and may equivalently be achieved by any number of physical constructions utilizing functionally similar baffles, rotating seal components, and general stator and rotor constructions. In short summary, the scope of the invention is thus not limited by the preceding disclosure, but only by the claims appended hereinbelow.

We claim:

1. In an axial flow gas turbine engine having an annular flow of hot working fluid passing sequentially through a first bladed rotor stage, a vaned stator assembly, and a second bladed rotor stage corotating with the first rotor stage, the rotor stages including a generally axially extending seal runner defining a radially inner, gas tight boundary between the rotor stages and radially inward of the stator assembly, the first rotor blades, the stator vanes, and the second rotor blades each having an airfoil cross section extending spanwisely across the annular working fluid flow and each blade and vane further including a transversely extending platform disposed at the radially inner end of the corresponding airfoil span, the platforms of each rotor and the stator collectively defining a flow guide for the inner diameter of the annular stream of working fluid, the vane stage further including an annular seal shroud disposed radially inward of the vane platform and supported therefrom, the seal shroud and seal runner cooperatively defining a flow resistant rotating seal therebetween, wherein the improvement comprises means, disposed radially inward of the annular working fluid flow, for controlling the local gas temperature radially inward of the rotor and vane platforms, said controlling means including, a plurality of axially extending baffles spaced radially inward of the first rotor blade platform and the vane platforms, said baffles secured alternatingly to the downstream face of the first rotor and the upstream face of the stator assembly and overlapping axially to cooperatively define a plurality of annular mixing volumes between the working fluid flow path and the rotating seal, and means for conducting a flow of cooling gas into the innermost mixing volume disposed immediately adjacent to the upstream side of the rotating seal.

2. The gas turbine engine as recited in claim 1, wherein the seal runner includes a plurality of circumferentially extending knife edges, and the seal shroud is an annular, axially extending pad of abradable material.

3. The gas turbine engine as recited in claim 1, further comprising:

means, disposed radially inward of the working fluid annular gas flow path, for controlling the temperature of any gas flow leakage passing from the downstream side of the rotating seal radially outward into the annular working fluid flow path, including a double lipped annular baffle extending generally axially from the downstream side of the stator assembly, said baffle having a first lip disposed radially inward of a second lip, the first lip defining an innermost downstream mixing volume adjacent the downstream side of the rotating seal, the first and second lips collectively defining, in cooperation with the upstream face of the second rotor, an intermediate mixing volume.

4. The gas turbine engine as recited in claim 2, wherein the stator assembly further includes a stator pedestal volume defined between the seal shroud, the stator vane platforms, an upstream radial bulkhead extending between the vane platforms and the seal shroud, and a downstream supporting pedestal disposed between the seal shroud and the vane platforms, wherein the bulkhead further includes, a sized opening disposed between at least one intermediate temperature mixing volume for admitting a flow of gas therefrom into the pedestal volume, said opening being sized to achieve a gas temperature within the pedestal volume in excess of the temperature of the innermost upstream mixing volume adjacent the upstream side of the rotating seal.

* * * * *